US010030872B2

(12) United States Patent
Siden et al.

(10) Patent No.: US 10,030,872 B2
(45) Date of Patent: Jul. 24, 2018

(54) COMBUSTOR MIXING JOINT WITH FLOW DISRUPTION SURFACE

(75) Inventors: Gunnar Leif Siden, Greenville, SC (US); Clint L. Ingram, Greenville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 891 days.

(21) Appl. No.: 13/036,084

(22) Filed: Feb. 28, 2011

(65) Prior Publication Data

US 2012/0216542 A1 Aug. 30, 2012

(51) Int. Cl.

| | |
|---|---|
| ***F23R 3/46*** | (2006.01) |
| ***F01D 9/02*** | (2006.01) |
| ***F01D 11/00*** | (2006.01) |

(52) U.S. Cl.

CPC ..... *F23R 3/46* (2013.01); *F01D 9/023* (2013.01); *F01D 11/005* (2013.01)

(58) Field of Classification Search

CPC ..... F23R 3/46; F01D 9/023; F01D 11/005
USPC ..... 60/39.37, 752, 754–760; 415/185, 208.2, 415/914

See application file for complete search history.

(56) References Cited

U.S. PATENT DOCUMENTS

| | | | | | |
|---|---|---|---|---|---|
| 2,702,454 | A * | 2/1955 | Brown | 60/800 |
| 3,578,264 | A * | 5/1971 | Kuethe | 244/200.1 |
| 3,620,012 | A | 11/1971 | Wilde | |
| 3,657,882 | A | 4/1972 | Hugoson | |
| 3,776,363 | A * | 12/1973 | Kuethe | 181/213 |
| 4,149,375 | A * | 4/1979 | Wynosky et al. | 60/262 |
| 4,830,315 | A * | 5/1989 | Presz et al. | 244/200 |
| 5,110,560 | A * | 5/1992 | Presz et al. | 422/176 |
| 5,983,641 | A * | 11/1999 | Mandai et al. | 60/722 |
| 6,006,523 | A * | 12/1999 | Mandai et al. | 60/722 |
| 6,360,528 | B1 | 3/2002 | Brausch et al. | |
| 6,830,436 | B2 * | 12/2004 | Shibata et al. | 416/228 |
| 6,840,048 | B2 * | 1/2005 | Han et al. | 60/772 |
| 6,907,724 | B2 | 6/2005 | Edelman et al. | |
| 7,159,383 | B2 | 1/2007 | Barton et al. | |
| 7,533,534 | B2 * | 5/2009 | Alkabie | 60/772 |
| 7,571,611 | B2 | 8/2009 | Johnson et al. | |
| 8,065,881 | B2 * | 11/2011 | Charron et al. | 60/752 |
| 8,091,365 | B2 * | 1/2012 | Charron | 60/752 |
| 2007/0245741 | A1 | 10/2007 | Johnson et al. | |
| 2009/0145132 | A1 | 6/2009 | Johnson et al. | |

(Continued)

FOREIGN PATENT DOCUMENTS

| | | | | |
|---|---|---|---|---|
| JP | 2009197650 | A * | 9/2009 | F01D 9/02 |
| WO | 2008025178 | A1 | 3/2008 | |

OTHER PUBLICATIONS

The Jet Engine, Rolls-Royce Limited, 3rd Edition, Jul. 1969, p. 13.*

(Continued)

*Primary Examiner* — Lorne Meade
(74) *Attorney, Agent, or Firm* — Eversheds Sutherland (US) LLP

(57) ABSTRACT

A mixing joint for adjacent can combustors may include a first can combustor with a first combustion flow and a first wall, a second can combustor with a second combustion flow and a second wall, and a flow disruption surface positioned about the first wall and the second wall to promote mixing of the first combustion flow and the second combustion flow.

12 Claims, 5 Drawing Sheets

(56) References Cited

U.S. PATENT DOCUMENTS

| | | | | |
|---|---|---|---|---|
| 2009/0302169 | A1* | 12/2009 | Wright | 244/214 |
| 2010/0034643 | A1 | 2/2010 | Davis, Jr. et al. | |
| 2010/0037617 | A1* | 2/2010 | Charron et al. | 60/752 |
| 2010/0037619 | A1* | 2/2010 | Charron | 60/752 |
| 2010/0122538 | A1 | 5/2010 | Ning et al. | |
| 2010/0313567 | A1* | 12/2010 | Nakamura et al. | 60/722 |
| 2013/0291548 | A1* | 11/2013 | Ingram et al. | 60/772 |

OTHER PUBLICATIONS

European Search Report for EP Application No. 12 15 7134, dated Dec. 5, 2013.

* cited by examiner

COMBUSTOR MIXING JOINT WITH FLOW DISRUPTION SURFACE

TECHNICAL FIELD

The present application relates generally to gas turbine engines and more particularly relates to a joint between adjacent annular can combustors to promote mixing of the respective combustion streams downstream thereof before entry into the first stage of the turbine.

BACKGROUND OF THE INVENTION

Annular combustors often are used with gas turbine engines. Generally described, an annular combustor may have a number of individual can combustors that are circumferentially spaced between a compressor and a turbine. Each can combustor separately generates combustion gases that are directed downstream towards the first stage of the turbine.

The mixing of these separate combustion streams is largely a function of the free stream Mach number at which the mixing is taking place as well as the differences in momentum and energy between the combustion streams. Moreover, a stagnant flow region or wake in a low flow velocity region may exist downstream of a joint between adjacent can combustors due to the bluntness of the joint. As such, the non-uniform combustor flows may have a Mach number of only about 0.1 when leaving the can combustors. Practically speaking, the axial distance between the exit of the can combustors and the leading edge of a first stage nozzle is relatively small such that little mixing actually may take place before entry into the turbine.

The combustor flows then may be strongly accelerated in the stage one nozzle to a Mach number of about 1.0. This acceleration may exaggerate the non-uniformities in the flow fields and hence create more mixing losses downstream thereof. As the now strongly nonuniform flow field enters the stage one bucket, the majority of mixing losses may take place therein as the wakes from the can combustor joints may be mixed by an unsteady flow process.

There is thus a desire therefore for an improved combustor design that may minimize mixing loses. Such reduced mixing loses may reduce overall pressure losses without increasing the axial distance between the combustor and the turbine. Such an improved combustion design thus should improve overall system performance and efficiency.

SUMMARY OF THE INVENTION

The present application and the resultant patent thus provide a mixing joint for adjacent can combustors. The mixing joint may include a first can combustor with a first combustion flow and a first wall, a second can combustor with a second combustion flow and a second wall, and a flow disruption surface positioned about the first wall and the second wall to promote mixing of the first combustion flow and the second combustion flow.

The present application and the resultant patent further provide a method of limiting pressure losses in a gas turbine engine. The method may include the steps of positioning a mixing joint with a flow disruption surface on a number of can combustors, generating a number of combustion streams in the can combustors, substantially mixing the combustion streams in a low velocity region downstream of the can combustors, and passing a mixed stream to a turbine.

The present application and the resultant patent further provide a gas turbine engine. The gas turbine engine may include a number of can combustors, a mixing joint positioned between each pair of the can combustors, and a turbine downstream of the can combustors. The mixing joint may include a flow disruption surface thereon.

These and other features and improvements of the present application will become apparent to one of ordinary skill in the art upon review of the following detailed description when taken in conjunction with the several drawings and the appended claims.

DETAILED DESCRIPTION

Figure 1:
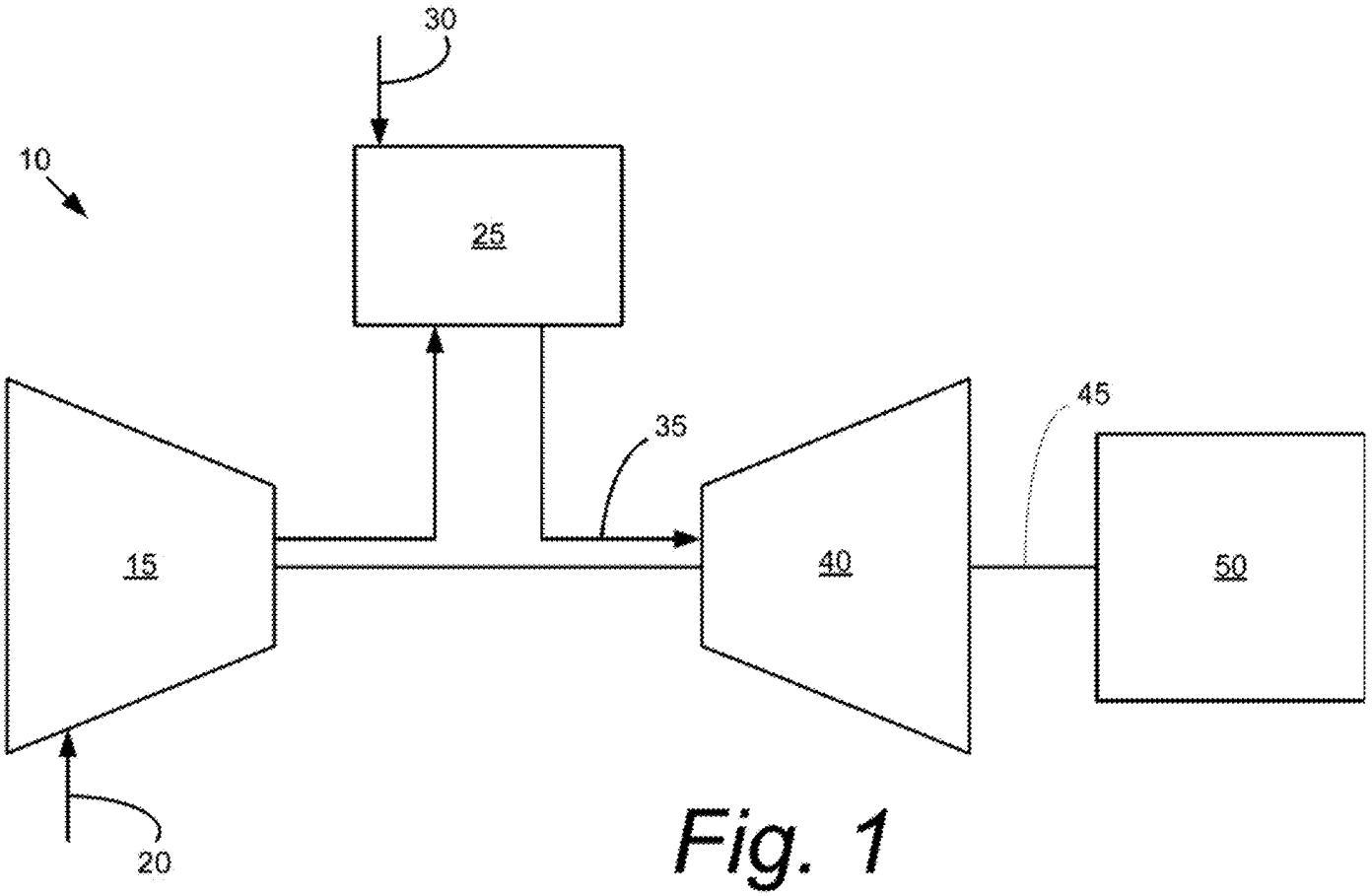
Fig. 1 Prior Art
FIG. 1 is a schematic view of a known gas turbine engine that may be used herein.

Referring now to the drawings, in which like numerals refer to like elements throughout the several views, FIG. 1 shows a schematic view of gas turbine engine 10 as may be used herein. The gas turbine engine 10 may include a compressor 15. The compressor 15 compresses an incoming flow of air 20. The compressor delivers the compressed flow of air 20 to a combustor 25. The combustor 25 mixes the compressed flow of air 20 with a compressed flow of fuel 30 and ignites the mixture to create a flow of combustion gases 35. Although only a single combustor 25 is shown, the gas turbine engine 10 may include any number of combustors 25. In this example, the combustor 25 may be in the form of a number of can combustors as will be described in more detail below. The flow of combustion gases 35 is in turn delivered to a downstream turbine 40. The flow of combustion gases 35 drives the turbine 40 so as to produce mechanical work. The mechanical work produced in the turbine 40 drives the compressor 15 via a shaft 45 and an external load 50 such as an electrical generator and the like.

The gas turbine engine 10 may use natural gas, various types of syngas, and/or other types of fuels. The gas turbine engine 10 may be any one of a number of different gas turbine engines such as those offered by General Electric Company of Schenectady, New York and the like. The gas turbine engine 10 may have different configurations and may use other types of components. Other types of gas turbine engines also may be used herein. Multiple gas turbine engines, other types of turbines, and other types of power generation equipment also may be used herein together.

Figure 2:
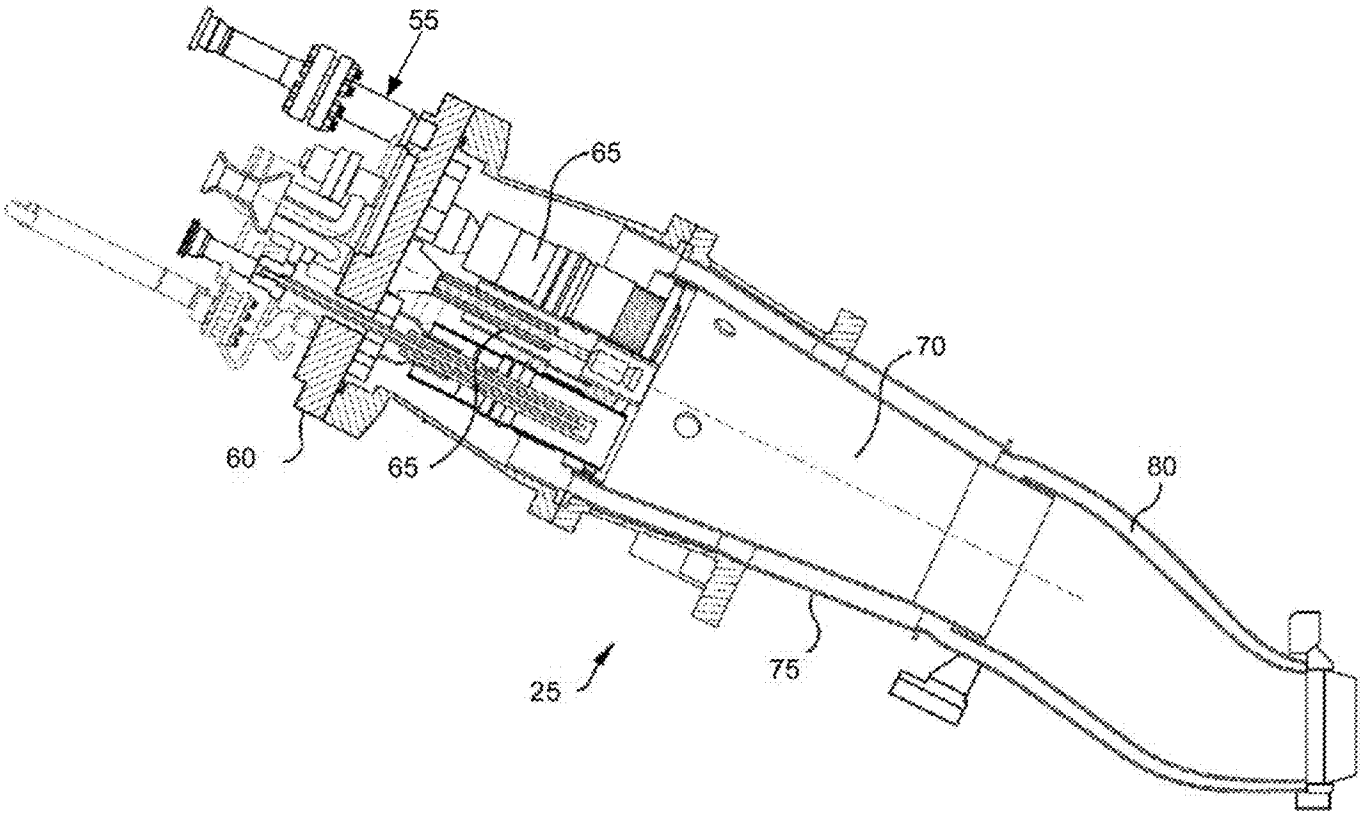
Fig. 2 Prior Art
FIG. 2 is a side cross-sectional view of a can combustor that may be used with the gas turbine engine of FIG. 1.

FIG. 2 shows one example of the can combustor 25. Generally described, the can combustor 25 may include a head end 55. The head end 55 generally includes the various manifolds that supply the necessary flows of air 20 and fuel 30. The can combustor 25 also includes an end cover 60. A number of fuel nozzles 65 may be positioned within the end cover 60. A combustion zone 70 may extend downstream of the fuel nozzles 65. The combustion zone 70 may be enclosed within a liner 75. A transition piece 80 may extend downstream of the combustion zone 70. The can combustor 25 described herein is for the purpose of example only. Many other types of combustor designs may be used herein. Other components and other configurations also may be used herein.

Figure 3:
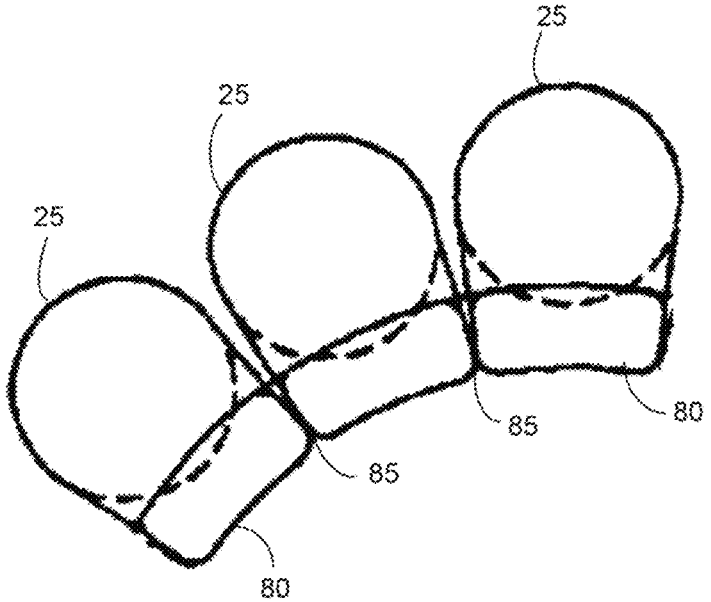
Fig. 3 Prior Art
FIG. 3 is a schematic view of a number of adjacent can combustors.
Figure 4:
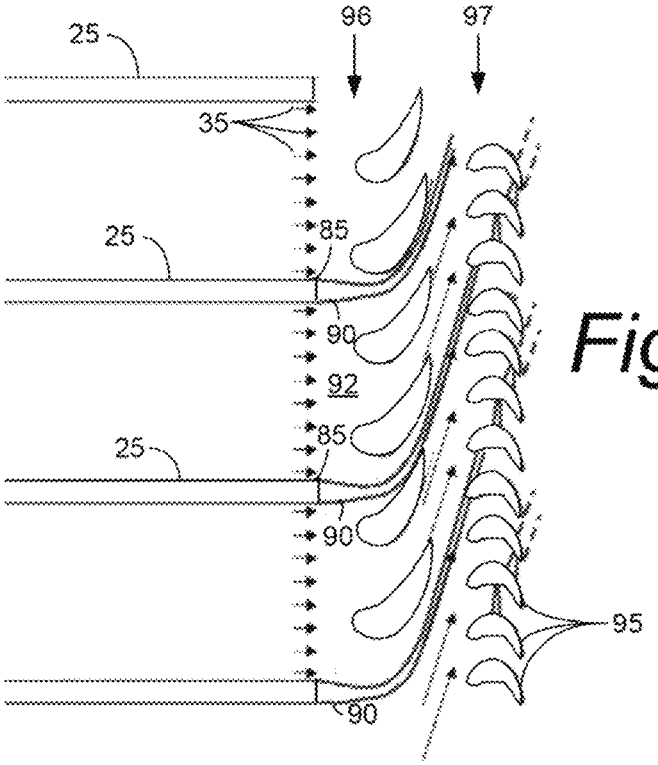
FIG. 4 is a schematic view of a number of adjacent can combustors and the first two rows of turbine airfoils with a wake downstream of the can combustors.

As is shown in FIG. 3, a number of the can combustors 25 may be positioned in a circumferential array. Likewise, as is shown in FIG. 4, the adjacent can combustors 25 may meet at a joint 85. As was described above, the flow of combustion gases 35 may create a wake 90 downstream of the joint 85. This wake 90 may be a stagnant flow in a low velocity flow region 92. The wakes 90 extend into the airfoils 95 of the turbine 40. Specifically, the wakes 90 extend into the airfoils 95 of a stage one nozzle 96, wherein the combustion gases 35 are accelerated so as to exaggerate the non-uniformities therein. The combustion gases 35 then exit the stage one nozzle 96 and enter a stage one bucket 97. The wakes 90 within the combustion gases 35 generally mix therein but incur significant mixing and pressure losses. Other components and other configurations may be used herein.

Figure 5:
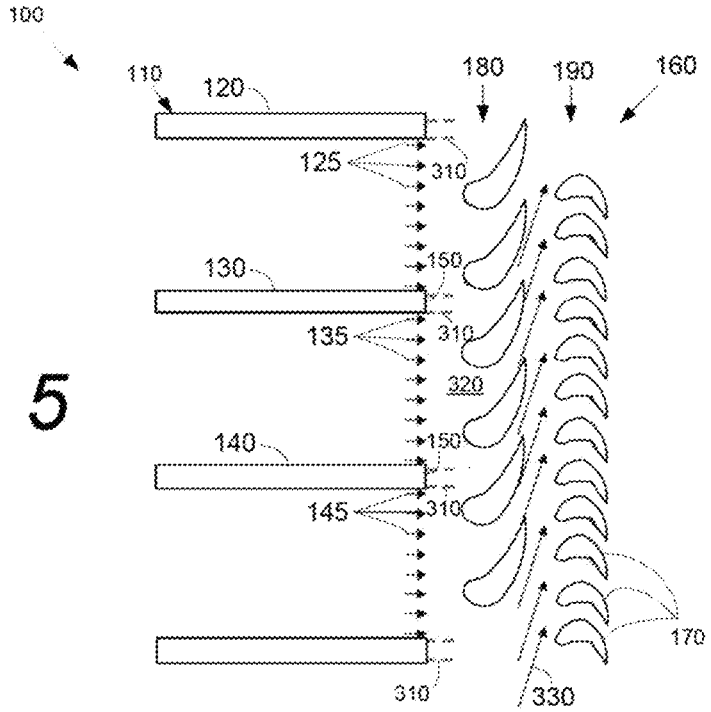
FIG. 5 is a schematic view of a number of adjacent can combustors and the first two rows of turbine airfoils illustrating the use of the can combustor mixing joints as may be described herein.

FIG. 5 shows as portion of a gas turbine engine 100 as may be described herein. The gas turbine engine 100 includes a number of adjacent can combustors 110. In this example, three (3) can combustors 110 are shown: a first can combustor 120 with a first combustion flow 125, a second can combustor 130 with a second combustion flow 135, and a third can combustor 140 with a third combustion flow 145. Any number of adjacent can combustors 110 may be used herein. Each pair of can combustors 110 meets at a mixing joint 150. Each mixing joint 150 may have a flow disruption surface 155 thereon so as to promote mixing of the combustion flows 125, 135, 145. The gas turbine engine 100 further includes a turbine 160 positioned downstream of the can combustors 110. The turbine 160 includes a number of airfoils 170. In this example, the airfoils 170 may be arranged as a first stage nozzle 180 and a first stage bucket 190. Any number of nozzles and buckets may be used herein. Other components and other configurations may be used herein.

Figure 6:
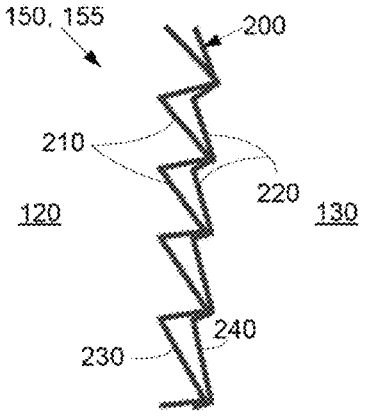
FIG. 6 is a schematic view of a can combustor mixing joint as may be described herein.
Figure 7:
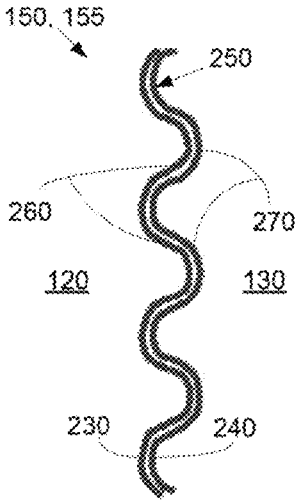
FIG. 7 is a schematic view of an alternative embodiment of a can combustor mixing joint as may be described herein.
Figure 8:
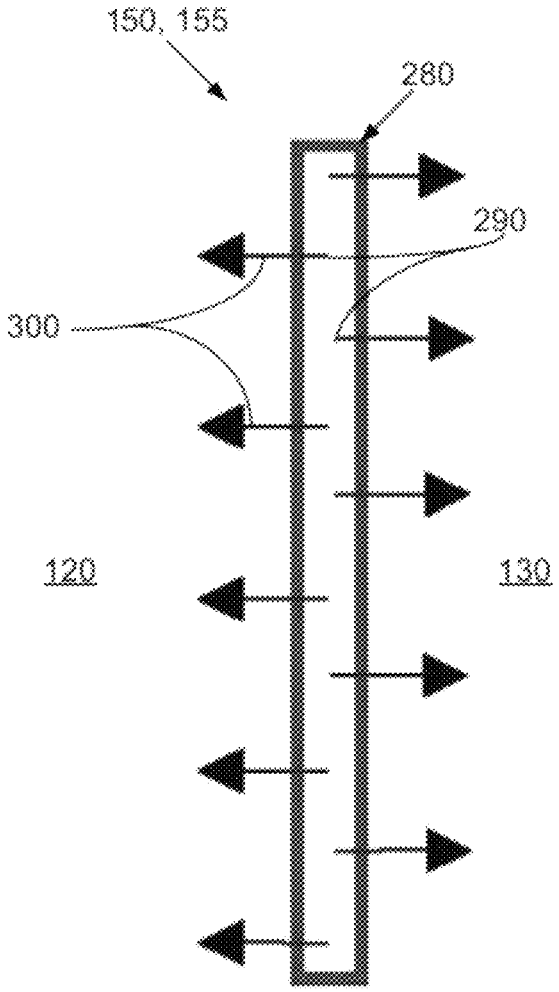
FIG. 8 is a schematic view of an alternative embodiment of a can combustor mixing joint as may be described herein.

FIGS. 6-8 show a number of different embodiments of the mixing joint 150 between adjacent can combustors 110 as may be described herein. FIG. 6 shows a chevron mixing joint 200. The chevron mixing joint 200 may include a first set of chevron like spikes 210 in the first can combustor 120 and a mating second set of chevron like spikes 220 in the second can combustor 130 as the flow disruption surfaces 155. The first and second set of chevron like spikes 210, 220 may be formed in a first wall 230 of the first can combustor 120 and an adjacent second wall 240 of the second can combustor 130. As is shown, the depth and angle of the first and second set of chevron like spikes 210, 220 may vary from the first can combustor 120 to the second can combustor 130. Likewise, the number, size, shape, and configuration of the chevron like spikes 210, 220 each may vary. Other components and other configurations may be used herein.

FIG. 7 shows a further embodiment of the mixing joint 150 as may be described herein. In this embodiment, a lobed mixing joint 250 is shown. The lobed mixing joint 250 may include a first set of lobes 260 in the first wall 230 of the first can combustor 120 and a second set 270 of lobes in the second wall 240 of the second can combustor 130 as the flow disruption surfaces 155. The first and second set of lobes 260, 270 may have a largely sinusoidal wave like shape and may mate therewith. The depth and shape of the first and second set of lobes 260, 270 also may vary. The number, size, shape, and configuration of the lobes 260, 270 may vary. Other components and configurations may be used herein.

FIG. 8 shows a further embodiment of the mixing joint 150. In this example, the mixing joint 150 may be in the form of a fluidics mixing joint 280 as is shown. The fluidics mixing joint 280 may include a number of jets 290 therein that act as a flow disruption surface 155. The jets 290 may spray a fluid 300 into the combustion flows 125, 135, 145 as they exit the first can combustor 120 and the second can combustor 130. The number, size, shape, and configuration of the jets 290 may vary. Likewise, the nature of the fluid 300 may vary. Other components and configurations may be used herein.

Referring again to FIG. 5, the use of the mixing joints 150 described herein thus results in a wake 310 that is much smaller than the wake 90 described above. Specifically, the wake 310 mixes with low losses in a low velocity region 320 immediately downstream of the mixing joint 150 and before entry into the first stage nozzle 180. The various geometries of the flow disruption surfaces 155 of the mixing joint 150 enhance the mixing of the combustion flows 125, 135, 145 from adjacent can combustors 110 in the low velocity region 320 into a mixed flow 330, thus resulting in significantly less mixing losses as compared to mixing downstream in the first stage nozzle 180, the first stage bucket 190, or elsewhere. This improved mixing thus reduces the overall pressure losses in the gas turbine engine 100 as a whole without increasing the axial distance between the can combustors 110 and the turbine 160.

The embodiments of the mixing joint 150 described herein are for purposes of example only. Any other mixing joint geometry or other type of flow disruption surface 155 that encourages mixing of the combustion flows 125, 135, 145 from adjacent can combustors 110 before entry into the turbine 160 may be used herein. Different types of flow disruption surfaces 155 may be used herein together. Other components and other configurations also may be used herein.

It should be apparent that the foregoing relates only to certain embodiments of the present application and that numerous changes and modifications may be made herein by one of ordinary skill in the art without departing from the general spirit and scope of the invention as defined by the following claims and the equivalents thereof.

We claim:

1. A mixing joint for adjacent can combustors of a gas turbine engine, the mixing joint comprising:

a first can combustor with a first combustion flow and a first wall;

a second can combustor with a second combustion flow and a second wall, wherein the first can combustor and the second can combustor meet at a joint between the first wall and the second wall; and a flow disruption surface positioned between the first wall and the second wall and configured to promote mixing of the first combustion flow and the second combustion flow within a flow mixing region positioned downstream of the first wall and the second wall, wherein the flow disruption surface comprises a first set of spikes defined by a downstream edge of the first wall and a second set of spikes defined by a downstream edge of the second wall.

2. The mixing joint of claim 1, wherein the first set of spikes and the second set of spikes comprise a chevron like spike.

3. The mixing joint of claim 1, wherein the flow disruption surface faces downstream from the first can combustor and the second can combustor.

4. The mixing joint of claim 1, wherein the first wall and the second wall extend radially with respect to a longitudinal axis of the gas turbine engine.

5. A gas turbine engine, comprising:

a plurality of can combustors positioned in a circumferential array;

a turbine positioned downstream of the plurality of can combustors; and a mixing joint positioned between each adjacent pair of the plurality of can combustors, wherein the mixing joint comprises:

a first can combustor with a first combustion flow and a first wall;

a second can combustor with a second combustion flow and a second wall, wherein the first can combustor and the second can combustor meet at a joint between the first wall and the second wall; and a flow disruption surface positioned between the first wall and the second wall and configured to promote mixing of the first combustion flow and the second combustion flow within a flow mixing region positioned downstream of the first wall and the second wall and upstream of the turbine, wherein the flow disruption surface comprises a first set of spikes defined by a downstream edge of the first wall and a second set of spikes defined by a downstream edge of the second wall.

6. The gas turbine engine of claim 5, wherein the first set of spikes and the second set of spikes comprise a chevron like spike.

7. The gas turbine engine of claim 5, wherein the flow disruption surface faces downstream from the first can combustor and the second can combustor, and wherein the flow disruption surface faces toward the turbine.

8. The gas turbine engine of claim 5, wherein the first wall and the second wall extend radially with respect to a longitudinal axis of the gas turbine engine.

9. A method of limiting pressure losses in a gas turbine engine, the method comprising:

providing a mixing joint between each adjacent pair of can combustors of a plurality of can combustors positioned in a circumferential array, wherein the mixing joint comprises:

a first can combustor with a first wall;

a second can combustor with a second wall, wherein the first can combustor and the second can combustor meet at a joint between the first wall and the second wall; and a flow disruption surface positioned between the first wall and the second wall, wherein the flow disruption surface comprises a first set of spikes defined by a downstream edge of the first wall and a second set of spikes defined by a downstream edge of the second wall;

generating a plurality of combustion flows in the plurality of can combustors;

substantially mixing the plurality of combustion flows in a flow mixing region positioned downstream of the first wall and the second wall and upstream of a turbine, thereby producing a mixed stream; and passing the mixed stream to the turbine.

10. The method of claim 9, wherein the first set of spikes and the second set of spikes comprise a chevron like spike.

11. The method of claim 9, wherein the flow disruption surface faces downstream from the first can combustor and the second can combustor, and wherein the flow disruption surface faces toward the turbine.

12. The method of claim 9, wherein the first wall and the second wall extend radially with respect to a longitudinal axis of the gas turbine engine.

* * * * *